US006460362B1

(12) United States Patent
Oliveira de Barros et al.

(10) Patent No.: US 6,460,362 B1
(45) Date of Patent: Oct. 8, 2002

(54) ASSEMBLY GUIDES FOR MOLDED COMPONENTS

(75) Inventors: Daniel Alessandro Oliveira de Barros, Novo Hamburgo (BR); Gilberto Fagundez de Souza, Porto Alegre (BR); Paulo Augusto Lisboa Ramos, Esteio (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/743,663

(22) PCT Filed: May 28, 1999

(86) PCT No.: PCT/BR99/00037

§ 371 (c)(1),
(2), (4) Date: Apr. 19, 2001

(87) PCT Pub. No.: WO00/73707

PCT Pub. Date: Dec. 7, 2000

(51) Int. Cl.[7] ..... F25D 23/12
(52) U.S. Cl. ..... 62/262; 62/298

(58) Field of Search ..... 62/262, 298, 285, 62/279; 411/315

(56) References Cited

U.S. PATENT DOCUMENTS

| | | | | |
|---|---|---|---|---|
| 3,561,075 A | | 2/1971 | Selinko | 24/217 |
| 4,031,935 A | * | 6/1977 | Jones et al. | |
| 5,638,693 A | | 6/1997 | Baek | 62/262 |

FOREIGN PATENT DOCUMENTS

| | | |
|---|---|---|
| DE | 19732346 | 2/1999 |

* cited by examiner

*Primary Examiner*—Chen-Wen Jiang

(57) ABSTRACT

A molded component having a through opening configured to receive a fastener therethrough for attachment of the component to another structure. The through opening has a longitudinal axis. Integrally formed within the molded component is a guide structure which surrounds the through opening and extends axially outwardly and radially outwardly from the through opening. The guide structure is configured to contact a threaded fastener and/or an installation tool holding a threaded fastener to thereby guide the fastener into the through opening.

5 Claims, 4 Drawing Sheets

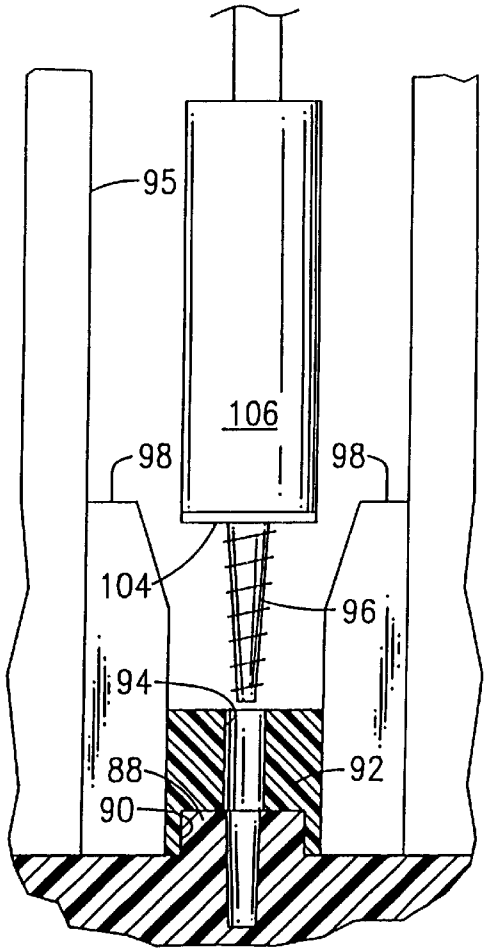
FIG.7
FIG.5
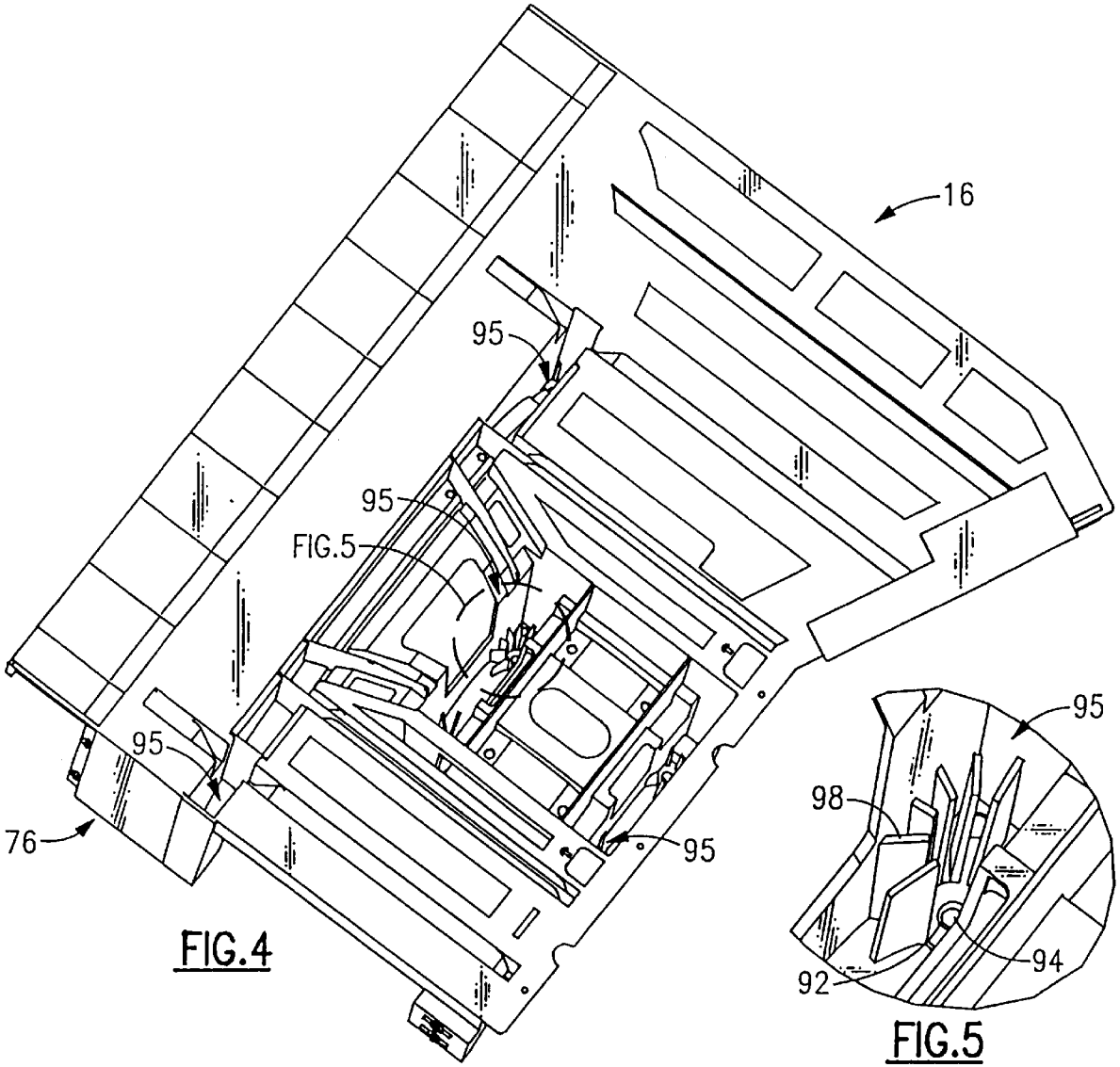
FIG.4

ASSEMBLY GUIDES FOR MOLDED COMPONENTS

TECHNICAL FIELD

The present invention is directed to the assembly of large molded components and, more particularly, to guide structure molded into large plastic components to facilitate assembly of such components to other structures.

BACKGROUND ART

Air conditioning units such as so-called "window room air conditioners" are commonly used for residential and similar applications and, generally, include closed refrigeration circuits having an evaporator and a condenser. The unit is normally divided by a partition into an evaporator section and a condenser section, the evaporator section communicating with the room air to be conditioned and the condenser communicating with external air such as outdoor air. Refrigerant flows through the refrigerant circuit absorbing heat from the room air at the evaporator and discharging heat energy to the external air at the condenser. The conventional refrigeration circuit is completed by the addition of a compressor, an expansion device, and the appropriate connections between the components.

Such air conditioning units usually include a basepan supporting all of the components and an outer housing surrounding the entire unit. The front of the evaporator, or indoor section, includes an indoor grille, which has openings for directing warm indoor air into the evaporator and discharge openings for directing air back into the room. The outdoor section of the housing includes a plurality of openings in the sides and top thereof, which serve an inlet openings for the cooling air which flows into the outdoor section and outwardly therefrom after passing through the condenser coil, which is mounted vertically in the back of the outdoor section.

In addition to the components mentioned above, the outdoor section also typically includes an outdoor fan and fan orifice, as well as an electric motor which typically also drives an indoor fan. The indoor section also typically includes the aforementioned indoor fan, an outdoor fan orifice, a control box and a fan scroll structure for directing the air cooled by the evaporator back into the room to be cooled. Each of the aforementioned components requires means for attaching it to the basepan and/or other structure of the air conditioning unit. Numerous approaches are known for assembly of the components in a manner which will minimize the number of individual components required for assembly of the unit. The fewer components and the fewer number of attachment means results in lower material costs, less labor content and, accordingly, a less expensive unit.

PCT Application Number PCT/BR98/00074 entitled Window Room Air Conditioner filed on Sept. 16, 1998 relates to an improvement in the structure of a window room air conditioner wherein a large molded component having a top wall is configured to overlie at least a portion of both the indoor section and the outdoor section. The top wall has, integrally formed therewith, a downwardly extending partition wall section, a section which is configured to cooperate and partially define the condenser fan shroud, structure for facilitating mounting of the motor, and structure for supporting the indoor components of the air conditioning unit. Such large plastic components are configured to be attached to underlying components which they structurally compliment and/or support. Because such large components are extremely deep, openings formed therein for facilitating fastening to underlying components are typically located near the bottom thereof and vertically extending access passageways extend from the top of the component downwardly to the openings provided for the fasteners. Such arrangement has proven to provide some inconvenience during assembly in that it is not always easy to direct threaded fasteners downwardly through the fastener access passageways. As a result, it is deemed desirable to provide a means for expediting and facilitating accurate insertion of such fasteners and the tools manipulating such fasteners.

DISCLOSURE OF THE INVENTION

A molded component having a through opening configured to receive a fastener therethrough for attachment of the component to another structure. The through opening has a longitudinal axis. Integrally formed within the molded component is a guide structure which surrounds the through opening and extends axially outwardly and radially outwardly from the through opening. The guide structure is configured to contact a threaded fastener and/or an installation tool holding a threaded fastener to thereby guide the fastener into the through opening.

BRIEF DESCRIPTION OF THE DRAWINGS

The invention may be better understood and its objects and advantages will become apparent to those skilled in the art by reference to the accompanying drawings, in which:

FIG. 4 is a top perspective view of the front portion of the component illustrated in FIG. 1;

FIG. 5 is an enlarged view of a portion of FIG. 4;

FIG. 7 is a detailed view of the present invention cooperating with a fastener and installation tool.

BEST MODE FOR CARRYING OUT THE INVENTION AND INDUSTRIAL APPLICABILITY

Figures 1, 2:
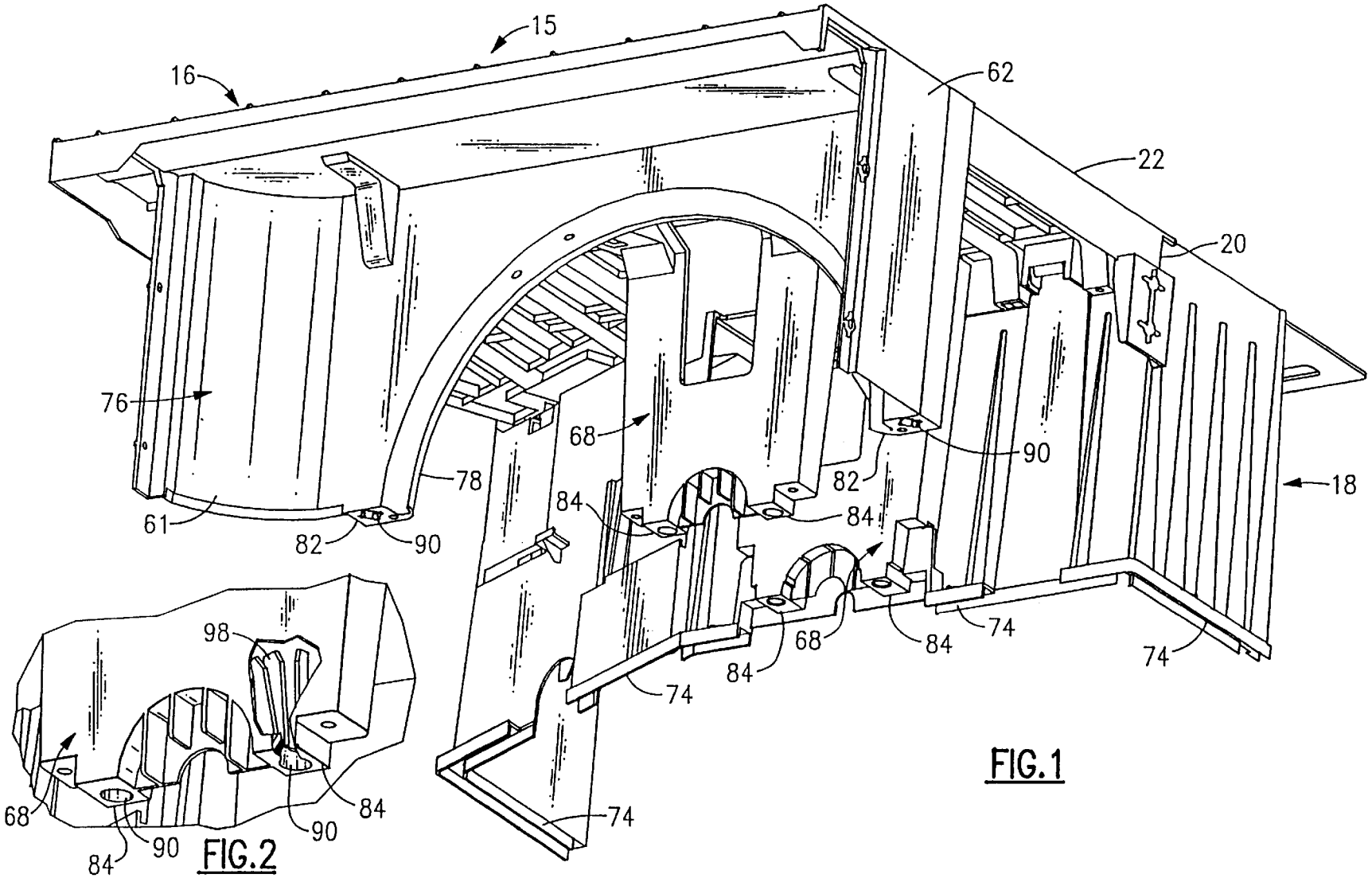
FIG. 1 is a bottom rear perspective view of a molded plastic component embodying the present invention.
FIG. 2 is an enlarged view partially broken of a portion of FIG. 1.
Figure 3:
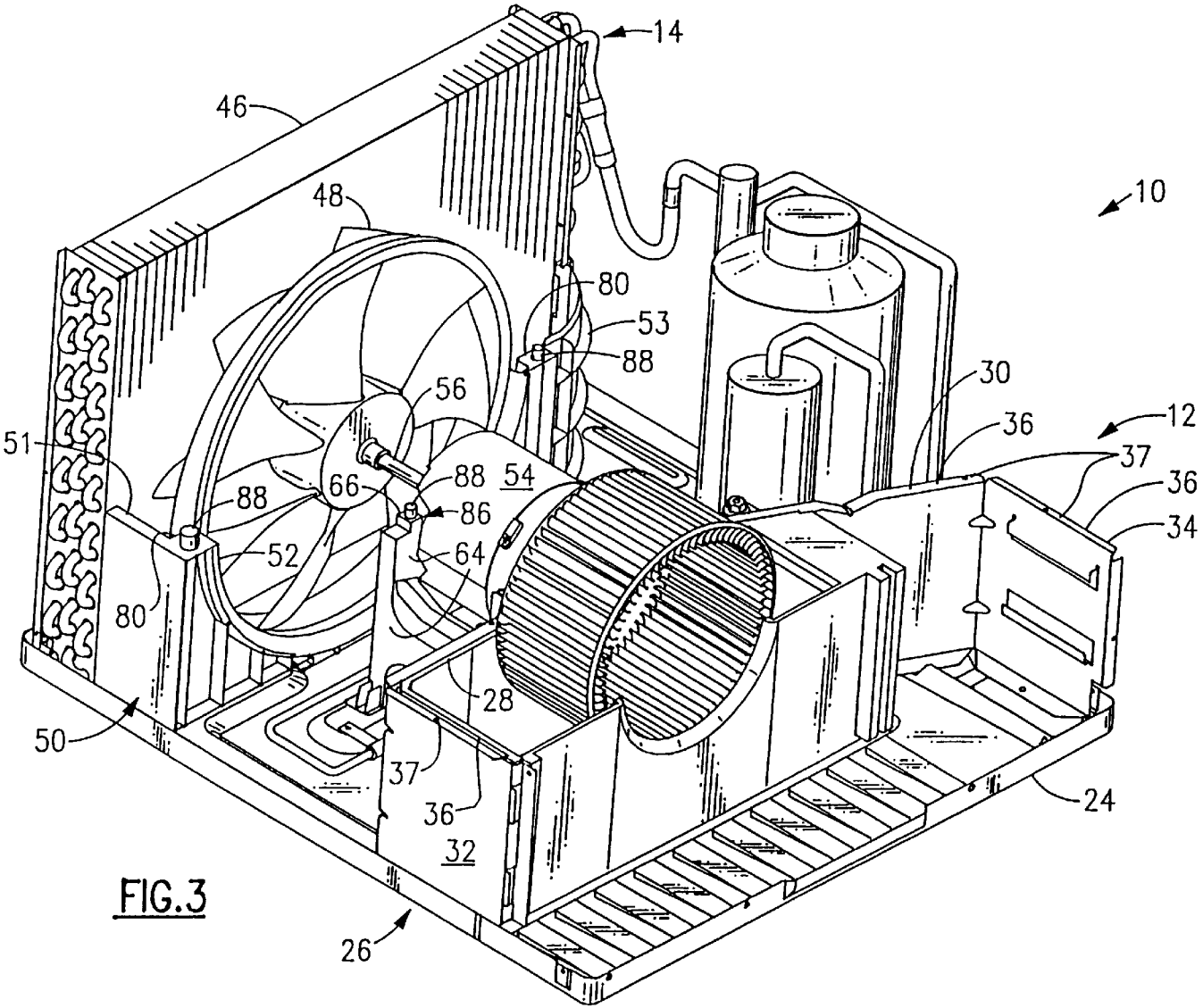
FIG. 3 is a front perspective view of a partially assembled window air conditioner configured to receive the component illustrated in FIG. 1.
Figure 6:
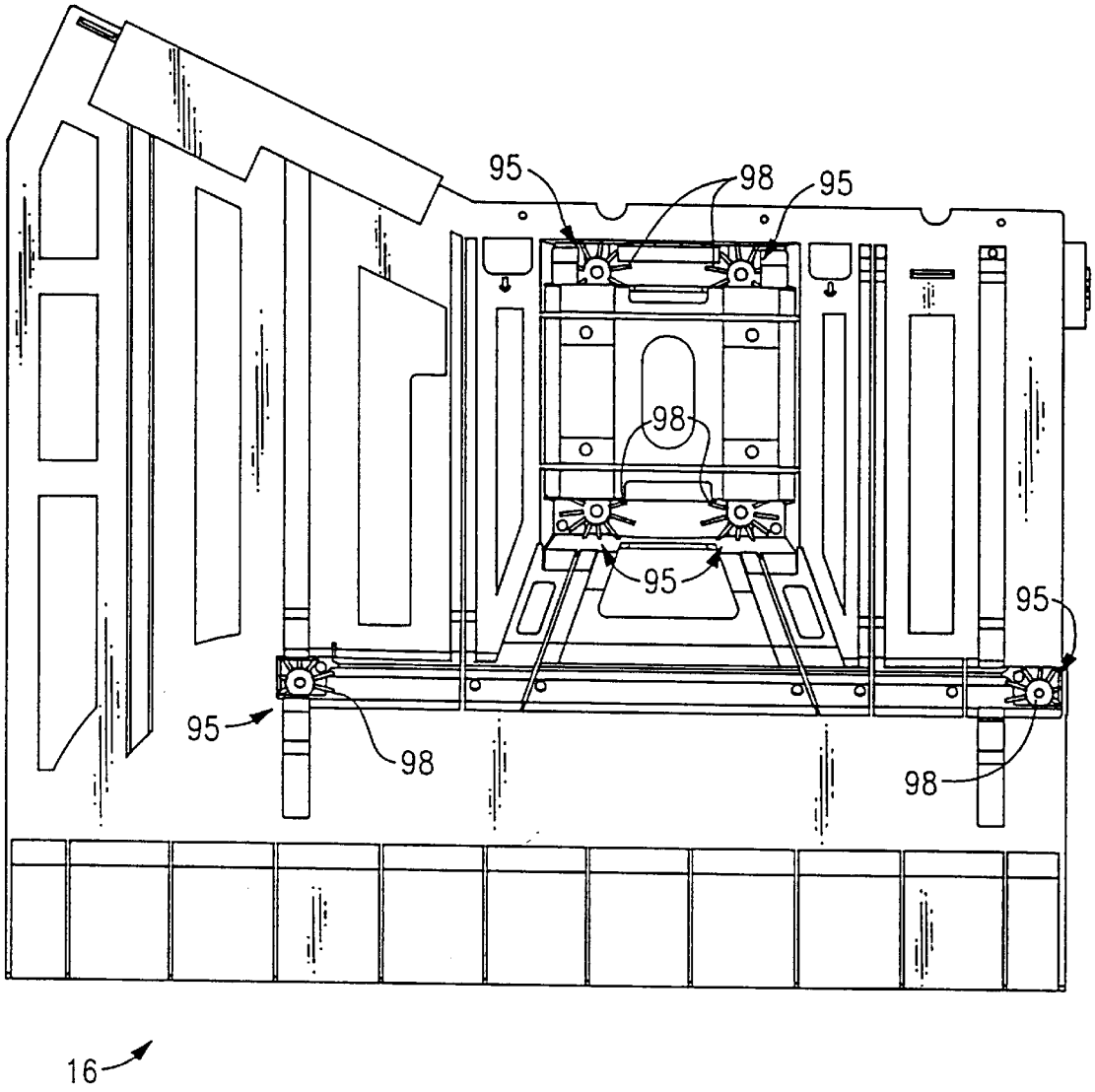
FIG. 6 is a top elevational view of the component shown in FIG. 4.

Referring first to FIG. 3, a partially assembled room air conditioner unit 10, which includes, generally, an indoor section 12 and an outdoor section 14, is illustrated. The room air conditioner 10 is designed such that when all of the operable components are installed therein, a large two-piece molded plastic component 15 illustrated in FIG. 1 is assembled to the unit in a position overlying all of the components. The component 15 is then attached to mating structure, as will be described below. Following installation of the molded component 15, the room air conditioner is adapted to be enclosed in a substantially rectangular housing and to be positioned in a rectangular opening in an exterior wall or in a room where cooling is desired, with the indoor section 12 facing into the room, as is conventional.

With continued reference to FIG. 3, the components of both the indoor section 12 and outdoor section 14 are supported in a rectangular basepan 24. The indoor and outdoor sections are separated by a vertically extending metal partition. A sheet metal structure forming the lower half 26 of the partition is illustrated assembled to the basepan. The metal partition 26 includes a planar section 28 extending transversely to the air conditioning unit, a second partially angularly disposed yet transversely extending section 30, and left and right-hand end sections 32 and 34 which extend forwardly from the transverse sections 28 and 30 to define in part the indoor section 12 of the unit. Each of the wall sections 28, 30, 32 and 34 of the partition 26 have a horizontally extending flange, collectively 36, formed at the upper ends thereof. Each of these flanges 36 is provided with one or more openings 37 therein for receiving a threaded fastener therethrough. As will be seen, these fasteners are fasteners which extend through the large molded component 15 to attach the component thereto.

The outdoor section 14 of the air conditioning unit 10 includes a condenser coil 46 vertically disposed adjacent the back end thereof and a condenser fan 48 located within the outdoor section adjacent the condenser coil. The lower half 50 of a condenser fan shroud is connected to the condenser coil 46 and the basepan 24. The condenser fan shroud defines one-half of a condenser fan inlet orifice 52. The lower shroud 50 defines several upwardly facing wall sections 51 and 53 at the left and right ends, respectfully, thereof, which are configured to cooperate with mating structure on the plastic component 15 when it is assembled to the air conditioning unit.

The condenser fan 48 is connected to an electric motor 54 via drive shaft 56, which also extends from the other side of the electric motor where it is connected to the evaporator fan 42 such that both fans are commonly driven. The motor is supported in a motor mounting pedestal 64, which presents an upwardly facing support configurations 66, which is cooperatively engaged by motor support structure 68 provided on the molded component 15.

As previously mentioned, the molded component 15, as illustrated, is made from two parts, a rear section 16 and a front section 18. The front and rear sections 18 and 16 are joined at parting line 20, and when installed on the air conditioning unit cooperate to define a substantially planar top wall 22. Extending vertically downwardly from the top of the front section 18 is the upper half of the partition 72, which has wall segments which define lower mounting flanges 74, which are configured to engage the upwardly extending flanges 36 defined by the wall sections 28, 30, 32 and 34 of the metal lower partition 26. Attachment of the front section 18 is achieved by passing threaded fasteners (not shown) through mating openings in the lower flanges 74 and into mating openings 37 in the flanges 36 of the metal partition.

The rear section 16 of the molded component 15 has vertically extending downwardly therefrom an upper shroud wall 76, which has formed therein a semi-circular opening defining the upper half of the condenser fan orifice 52. As best seen in FIG. 1, located at the left and right-hand ends (as viewed in FIG. 1) of the semi-circular opening 52 are wall sections 61 and 62, which are configured to cooperate with wall sections 53 and 51, respectively, of the lower shroud 50. Located on each of the walls 53 and 51 adjacent the semi-circular opening 78 are structural attachment configurations 80, which are configured to structurally cooperate with the mating configurations 82 formed at the lower end of the upper walls of the lower shroud 50.

Also extending downwardly from the top wall 22 of the rear section 16 are the two previously mentioned motor support structures 68. Each of the motor supports is provided with two structural configurations 84 thereon, which are configured to structurally engage mating configurations 86 provided at the top of the motor mounting pedestal 64.

Each of the above described structural interconnections 80/82 for the condenser shroud and 84/86 for the motor mounting are similar in that each has formed on the lower configuration a pin element 88 adapted to be received in a mating opening 90 on its mating upper configuration. As is best seen in FIGS. 2 through 7, the openings 90 for receiving the pins 88 are formed in substantially thick structural sections 92 which have through openings 94 therein which are adapted to receive threaded fasteners 96 therethrough in order to structurally interconnect each of the upper structural configurations with its mating bottom configuration.

As is evident from the drawing figures, the structural wall sections 92 containing the attachment openings 94 of each of the top structural configurations is located at the bottom of a vertically extending access passageway 95, which extends from the top wall 22 a distance downwardly substantially equal to the height of the molded section 16.

According to the present invention, a plurality of vertically extending fin-like elements 98 are molded into the rear section 16 at the bottom of each of the access passageways 95. The fins 98 extend radially outwardly and vertically upwardly in surrounding relationship to the structural sections 92 in which the screw receiving openings 94 are formed. The fins 98 are formed so that they flare gradually outwardly from their origination point adjacent the structural section 92 as they extend upwardly.

The guide fins 98 are sized and configured such that when a threaded fastener 96 is attached by its head 104 to an installation tool 106, as seen in FIG. 7, the fins will engage the fastener 96 and/or the installation tool 106 and guide the fastener and tool into the receiving openings 94.

As a result of the above-described structure, when an air conditioning unit is being assembled on a production line where the operator has a minimal amount of time to install the plurality of fasteners 96, the guide fins 98 will greatly facilitate trial and error attempts in guiding the threaded fasteners 96 and installation tool into the desired position for facilitating threading of the fasteners 96 to complete installation of the rear section 16 to the air conditioning unit.

It should be understood that while the invention has been described in connection with an air conditioning unit, that it is equally applicable to facilitating the installation of any molded component, whether it be plastic or metal, in the situation where access to openings for fasteners are at a remote location.

What is claimed is:

1. A molded component having a through opening therein configured to receive a fastener therethrough for attachment of the component to another structure, said opening having a longitudinal axis, wherein the improvement comprises:

integrally formed guide structure surrounding said through opening and extending axially outwardly and radially outwardly from said opening, said guide structure being configured to contact a threaded fastener and/or a tool holding a threaded fastener and to guide said fastener into said opening.

2. The apparatus of claim 1 wherein said guide structure comprises a plurality of substantially planar fin elements, each of said fin elements extending radially outwardly from said opening.

3. The apparatus of claim 2 wherein each of said fin elements has an upper end, a lower end, and a guide edge in close radial proximity to said opening, said guide edge being spaced farther away from said opening at said upper end than at said lower end.

4. The apparatus of claim 3 wherein said molded component has a first surface and a second surface, said first and second surfaces being spaced apart, said through opening being located in said second surface, said molded component having formed therein an access passageway in axial alignment with said opening, said first surface having an opening therein, which defines one end of said passageway and said through opening and said fin elements being formed at the other end of said passageway.

5. The apparatus of claim 4 wherein said molded element comprises a component of an air conditioning unit, said component being configured to overlie other structural and functional components of said air conditioning unit and to be structurally attached to said structural components, said molded component having formed therein a plurality of through openings, and a plurality of access passageways to facilitate attachment thereof to said structural components of said air conditioning unit.

* * * * *